US009115494B1

(12) United States Patent
Golding, III

(10) Patent No.: US 9,115,494 B1
(45) Date of Patent: Aug. 25, 2015

(54) PASSIVE/DYNAMIC SOLAR ENERGY SYSTEM

(71) Applicant: Lloyd Layton Golding, III, Alexandria, VA (US)

(72) Inventor: Lloyd Layton Golding, III, Alexandria, VA (US)

( * ) Notice: Subject to any disclaimer, the term of this patent is extended or adjusted under 35 U.S.C. 154(b) by 270 days.

(21) Appl. No.: 13/951,903

(22) Filed: Jul. 26, 2013

Related U.S. Application Data

(60) Provisional application No. 61/676,655, filed on Jul. 27, 2012.

(51) Int. Cl.
*E04D 13/03* (2006.01)
*E04D 13/035* (2006.01)

(52) U.S. Cl.
CPC ..... *E04D 13/033* (2013.01); *E04D 13/035* (2013.01)

(58) Field of Classification Search
CPC ..... Y02E 10/40; Y02E 10/44; Y02B 10/20
USPC ..... 126/714, 621
See application file for complete search history.

(56) References Cited

U.S. PATENT DOCUMENTS

| | | | | | |
|---|---|---|---|---|---|
| 3,205,491 | A * | 9/1965 | Brown et al. | 341/9 |
| 3,400,275 | A * | 9/1968 | Trump | 250/231.16 |
| 4,338,517 | A * | 7/1982 | Perrine | 250/231.13 |
| 4,849,621 | A * | 7/1989 | Yanase et al. | 250/214 PR |
| 5,828,500 | A * | 10/1998 | Kida et al. | 359/798 |
| 7,569,808 | B2 * | 8/2009 | Yoshioka | 250/231.14 |
| 8,960,180 | B2 * | 2/2015 | Cho et al. | 126/569 |
| 2009/0152478 | A1 * | 6/2009 | Denk et al. | 250/551 |

OTHER PUBLICATIONS

STIC search NPL and NPL2.*

* cited by examiner

*Primary Examiner* — Gregory Huson
*Assistant Examiner* — Nikhil Mashruwala

(57) ABSTRACT

A solar energy apparatus is provided for conditioning a building. The apparatus includes a first shield having a generalized cylindrical shape with an opening along its curved surface. The first shield rotates about the perimeter of a building at a first rotational speed. A second shield, also having a generalized cylindrical shape and with an opening along its curved surface, rotates concentrically with the first shield and at a second, greater rotational speed. The speeds of each shield are preferably constant and rotation of both shields is in the same direction. The relative rotation of the shields creates an aperture that varies in size and position throughout the day and year to appropriately regulate the amount of daylight, solar energy and insulation to which the building is subjected.

19 Claims, 17 Drawing Sheets

© 2012 Golding

© 2012 Golding

DAILY/SEASONAL TEMPERATURE CLOCK

© 2012 Golding

© 2012 Golding

© 2012 Golding

© 2012 Golding

© 2012 Golding

© 2012 Golding

© 2012 Golding

© 2012 Golding

© 2012 Golding

PASSIVE/DYNAMIC SOLAR ENERGY SYSTEM

This application claims priority to U.S. Patent Application No. 61/676,655, filed Jul. 27, 2012, entitled Passive/Dynamic Solar Energy System.

MATERIAL SUBJECT TO COPYRIGHT PROTECTION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

With high energy costs and ever-increasing awareness of environmental issues, the utilization of solar energy in building architecture and design has continued to evolve and grow. Particularly, many have turned to passive solar energy technologies as a practical and cost-effective alternative to traditional energy sources such as fossil fuels for meeting a building's conditioning needs.

Passive solar technology and design refers to the harnessing of the sun's energy for the heating, cooling, and lighting of buildings and living spaces. Passive solar energy systems typically operate by incorporating the building itself or some element associated therewith to collect, store, and transfer solar energy in the form of thermal energy in the winter and provide shade to reflect thermal energy in the summer. Passive solar energy systems take advantage of a building's location, climate, and materials to achieve energy savings and reduction of environmental damage, without sacrificing functionality or aesthetics. Such systems require minimal maintenance and require little to no mechanical or electrical devices.

Generally, conventional passive solar systems by nature are simple and static with few moving parts. As a consequence, however, once a passive solar building is built, the thermal characteristics of that building are often fixed and dictated primarily by its external thermal environment as a function of its location. Accordingly, there is a need for a dynamic passive solar energy system capable of providing passive thermal control in proportion to a building's average daily and seasonal conditioning needs irrespective of location.

SUMMARY OF THE INVENTION

A solar energy apparatus for conditioning a building is disclosed. The apparatus includes a first shield having a generalized cylindrical shape with an opening along its curved surface. The first shield rotates about or at the perimeter of a building at a first rotational speed. A second shield, also having a generalized cylindrical shape and with an opening along its curved surface, rotates concentrically with the first shield and at a second, greater rotational speed. The speeds of each shield are preferably constant and rotation of both shields is in the same direction for many applications. The shields can have insulating material and may be substantially opaque to solar energy. In an illustrative embodiment of the invention, each shield extends around about or at least half of the building's perimeter.

The combined openings of the first and second shields forming a rotating aperture through which solar energy can pass. The aperture size and location or position varies due to the speed differential between the shields. The location and size of the aperture can be calibrated to the external temperature and amount of sunlight to produce a selected amount of solar gain, insulating capacity, and shade.

An actuating assembly is provided for rotating the shields. The actuator assembly may include for example, a track system configured to support shield during rotation, and a motorized propulsion assembly for causing rotation of the shields with respect to the building.

In an exemplary embodiment of the invention, the first shield is configured to complete about one rotation per year and may be referred to as a circannual shield, and the second shield is configured to rotate slightly more than one rotation per day and is referred to as a circadian shield.

In an exemplary embodiment of the invention, the shields are configured and positioned to interact with one another so that the aperture width and position are proportional to average external temperatures based on historical data and the relative rotation of the shields results in a combined opening that increases gradually throughout the day to a maximum size at a first selected time, such as noon for example, and gradually decreases toward the evening to close at a second selected time, such as sunset for example.

The aperture admits an increasing amount of direct sunlight each day until the maximum amount of direct sunlight is admitted at the coldest time in an average year and the aperture provides an increasing amount of shade while maintaining maximum daylight until the maximum amount of shade occurs at the hottest time in an average year. At least one of the first shield opening and second shield opening is positioned so that the daily rotational gain of the first shield causes the midpoint of the first shield's opening and/or the second shield's opening to align toward the south at the coldest time in the year and toward the north at the warmest time in the year. A fixed time pointer may be disposed on or incorporated into the first shield that progressively points to time demarcations such as hours and minutes indicated on the second shield as the first shield and second shield rotate around the building. A fixed calendar pointer may be disposed on or incorporated into the building that progressively points to calendar demarcations indicated on the first shield such as days, months and seasons as the first shield and second shield rotate around the building.

The invention includes a building having a solar-energy apparatus as described, and may also have a networked ventilation system operably engaged to at least one of the shields for moving thermal energy within and out of the building. The networked ventilation system may comprise a plurality of cooling portals disposed along the perimeter of the building configured for regulating the building's cooling capacity. The cooling portals may be operably engaged to the first shield such that the rotational gain of the first shield opens an increasing amount of cooling ventilation portals until a maximum amount of cooling portals are open at a first preset time generally coinciding with the warmest time in the year and closes an increasing amount of cooling portals until all the cooling portals are closed at a second preset time generally coinciding with the coldest time of the year. A plurality of warming portals may also be disposed along the perimeter of the building configured to regulate the building's heating capacity. The warming portals are operably engaged to the first shield such that the rotational gain of the first shield opens an increasing amount of warming portals until a maximum amount of warming portals are open at the first preset time generally coinciding with the coldest time in the year and closes an increasing amount of warming portals until all the warming portals are closed at the second preset time generally coinciding with the warmest time of the year. The specific number of portals opening and closing can vary depending on the conditions.

A plurality of internal circulation portals can be disposed further within the perimeter of the building for transferring thermal energy within the building. The internal circulation portals can be operably engaged to the second shield such that the rotational gain of the second shield opens an increasing amount of the circulation portals until the maximum amount of circulation portals are open at a first preset time generally coinciding with the warmest time of the day, and such that the gain of the first shield closes an increasing amount of circulation portals until all the circulation portals are closed at a second preset time generally coinciding with the coldest time of day. As the seasonal temperatures get warmer an increasing amount of the circulation portals are opened until the maximum amount of circulation portals are open at a first preset time coinciding with the coldest time of the day, and an increasing amount of circulation portals are closed until all the circulation portals are closed at a second preset time coinciding with the warmest time of day.

The ventilation and circulation portals can be activated for example by a shield engaging a switch mechanism on the shield's actuating assembly, or activation can be programmed into the system.

A plurality of above eye-level windows can be included in the building wherein the shields rotate around the windows thereby blocking and admitting sunlight in response to passing of the aperture.

The invention includes methods for conditioning a building utilizing disclosed apparatus. The historically warmest month of the year and coldest month of the year at the building's location are identified. The historically warmest time of day and coldest time of day at the building's location are also identified. The shields are calibrated in accordance with the building's location by orienting the first shield opening toward the south at the historically coldest month of the year and orienting the second shield opening toward the south at the historically coldest time of day.

The invention also broadly covers a method of conditioning a building by providing a dynamic shielding mechanism having an aperture to alternately shield a building from solar energy and admit solar energy to impinge upon the building wherein the shielding mechanism is calibrated so the aperture size and position varies in proportion to the season and time of day to achieve a desired amount of solar gain, shading, insulation and daylight.

The invention includes the aperture apparatus and a building containing the aperture apparatus and having a ventilation system integrated with the aperture system. The invention also includes all methods described herein and a computer readable medium programmed to carry out the methods and an electronic system configured to carry out the methods and/or operate the apparatus. The electronic system includes a combination of all or some of the following: a machine readable storage medium containing an executable code; an apparatus having one or more processors; memory coupled to a processor; a machine-readable medium having machine-readable program code; an input device, a display and or controls.

The invention is generally disclosed as it would be configured and operate in the northern hemisphere. One skilled in the art will understand how an analogous invention would be configured for use in the southern hemisphere.

DESCRIPTION OF THE DRAWINGS

Illustrative embodiments of the invention are best understood from the following detailed description when read with the accompanying drawings.

DETAILED DESCRIPTION OF THE INVENTION

Embodiments of the invention provide a unique method for utilization of solar energy and seasonal lighting patterns to regulate the temperature and air circulation within a building or other enclosure. The invention also includes the associated system and building.

Figure 1A:
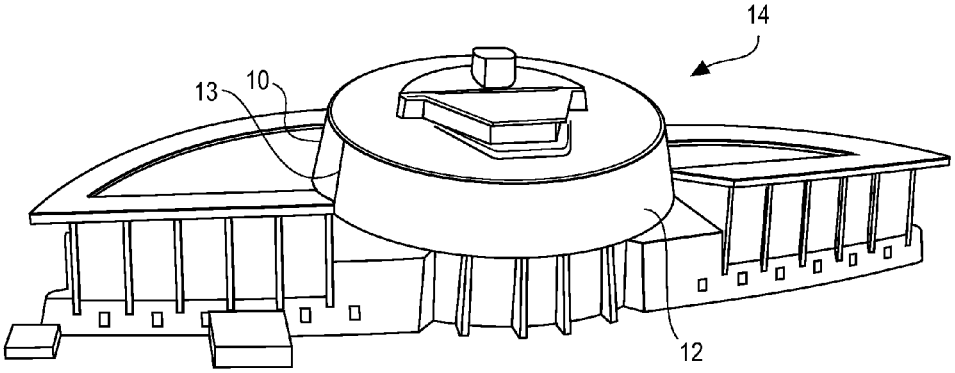
FIGS. 1A and 1B depict an elevation and a ground level plan view, respectively, of a building according to an illustrative embodiment of the invention.

FIG. 1A depicts a perspective elevation of a building 14 according to an illustrative embodiment of the invention. A passive dynamic solar aperture device comprising two or more shields, identified here by reference numbers 10, 12, rotate about an upper story central circular portion of the building and creates an aperture 13 that also rotates, thereby providing shade at various times of the day and admitting solar energy and daylight at other times.

Figure 1B:
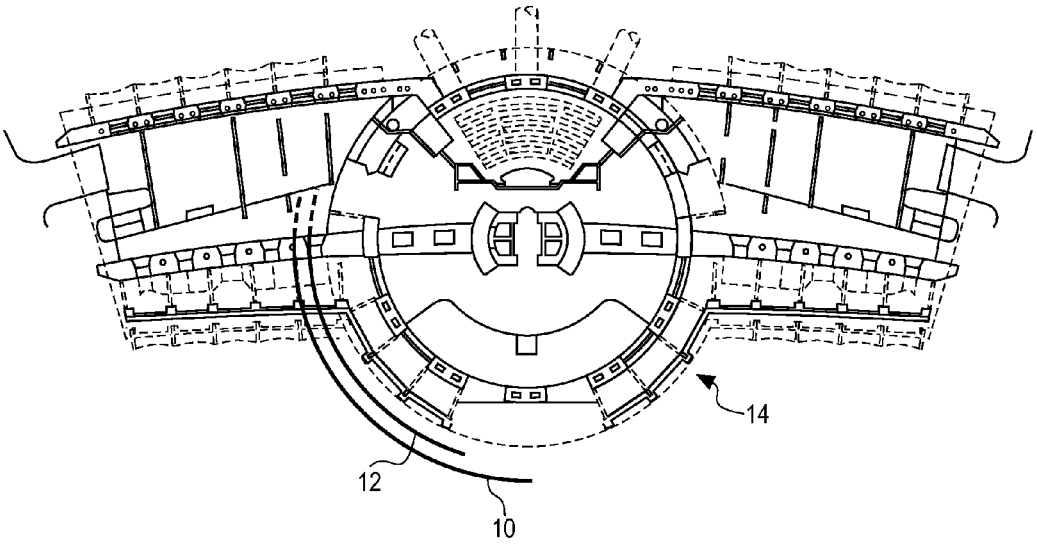
Figure 9:
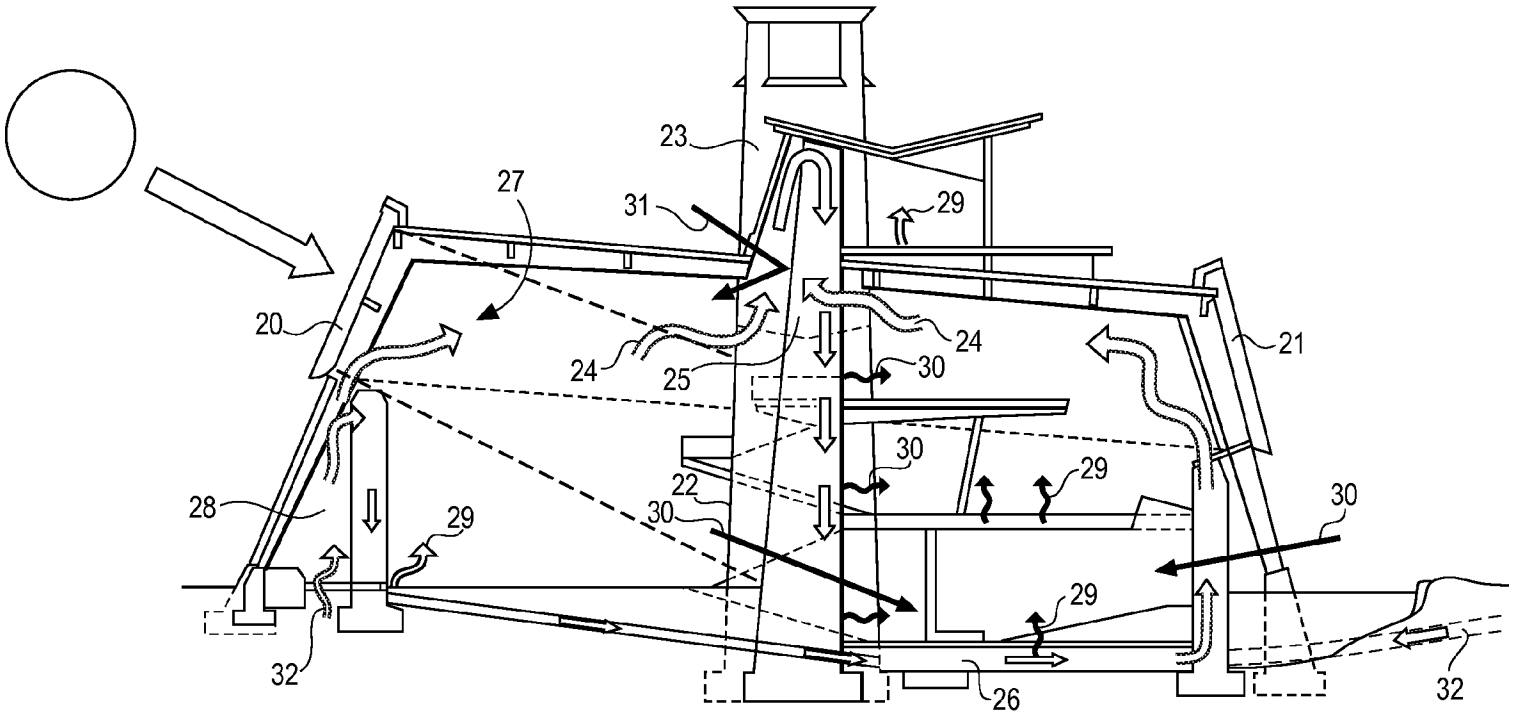
FIG. 9 is an illustrative embodiment of a configuration of an aperture system as implemented in the winter in the northern hemisphere according to an illustrative embodiment of the invention.
Figure 10:
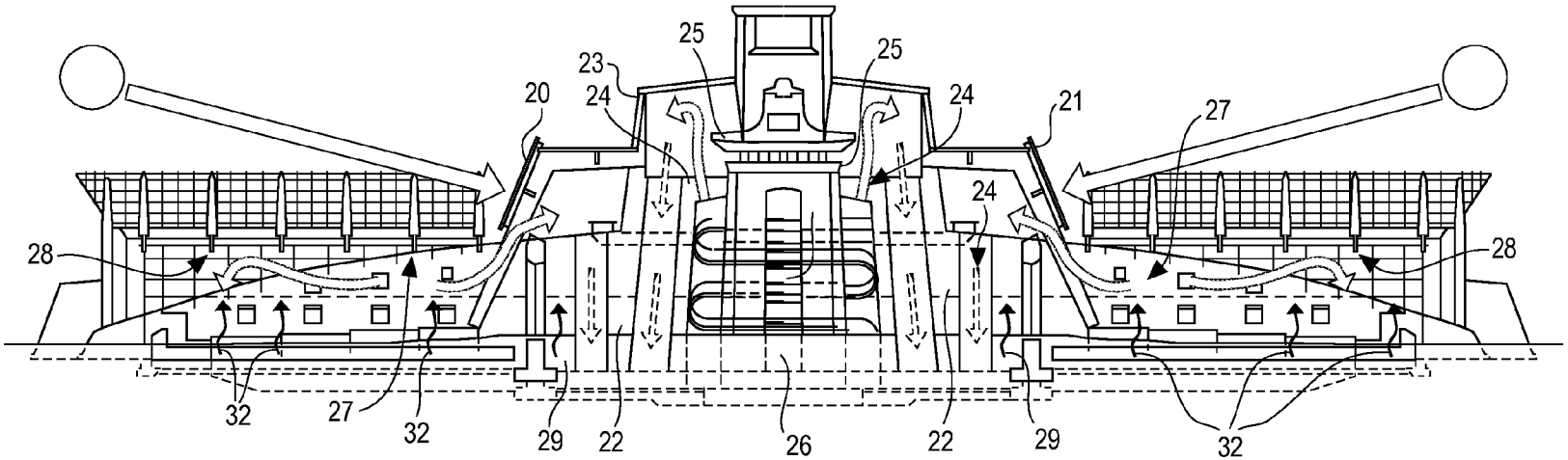
FIG. 10 shows an east-west cross section of a building as implemented in the winter in the northern hemisphere according to an illustrative embodiment of the invention.
Figure 11:
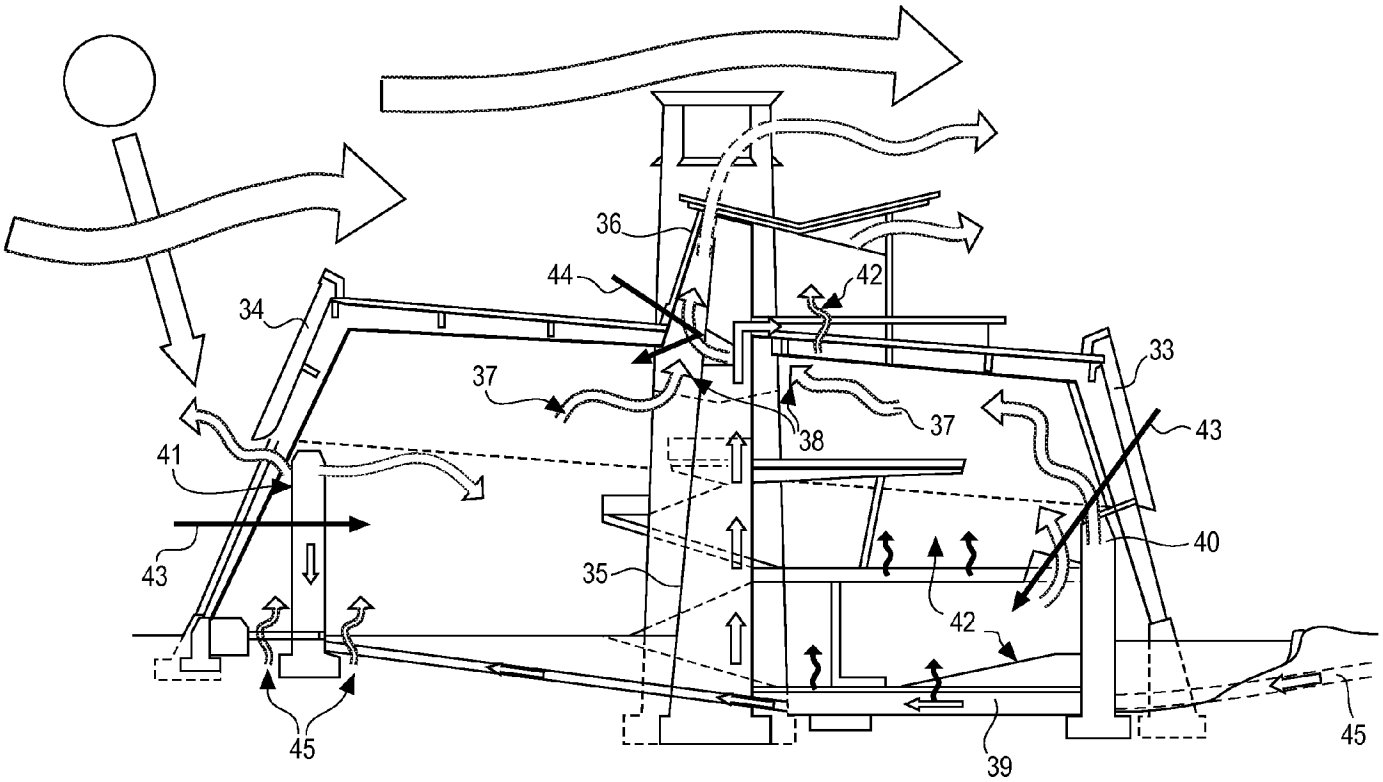
FIG. 11 depicts a south-north cross section of the building as implemented in the summer in the northern hemisphere according to an illustrative embodiment of the invention.

FIG. 1B is a plan view of a building designed to function as a dynamically responsive and breathing machine capable of passively and naturally conditioning itself year round. FIGS. 9-11 depict several interrelated systems that may work in concert creating natural ventilation flows, daylighting patterns, and passive solar heating and cooling events that wax and wane daily and seasonally in proportion to average outside temperatures. These systems are driven chiefly by the passive dynamic solar aperture device that regulates solar insolation (admittance) and shading of the building perimeter and also controls building space conditioning, ventilation, daylighting, and variable perimeter insulation levels in a dynamic manner. It is noted that the use of the term "perimeter" herein refers to the vicinity of an outside edge, and is not limited to an outermost line.

In many instances, the ideal passive solar system regulates exposure to direct sunlight, providing a maximum amount of exposure in the winter, a minimum amount in the summer, the median amount in the spring and fall, and an increasing or decreasing amount each day following the seasonal temperature change. Additionally, a maximum amount of daylight should be allowed year round while insulation should be maximized at night. The appropriate balance of daylight and temperature regulation can be selected, for example by a programmable regulation device. The dynamic solar aperture may perform the functions of allowing in daylight and providing insulation at night continuously and automatically.

The Solar Aperture System

Figure 2A:
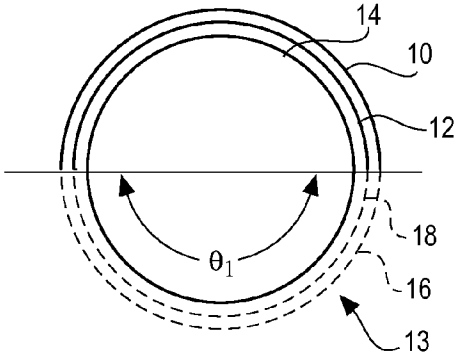
FIGS. 2A-2D are schematics of various shield positions and the resulting aperture according to an illustrative embodiment of the invention.
Figure 2B:
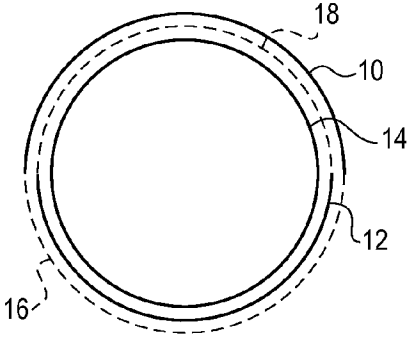
Figure 2C:
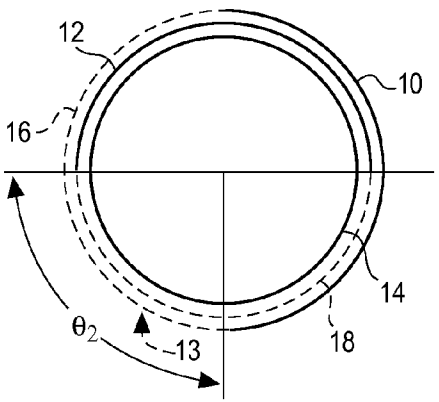

FIGS. 2A-D schematically depict an illustrative embodiment of the solar aperture system consisting of two rotating perimeter rings or shields 10, 12, preferably of shading and insulating material, concentric to each other that surround a building 14 or structure's envelope and its windows or openings. In FIGS. 2A-C, shield 12 is within shield 10.

Figure 3A:
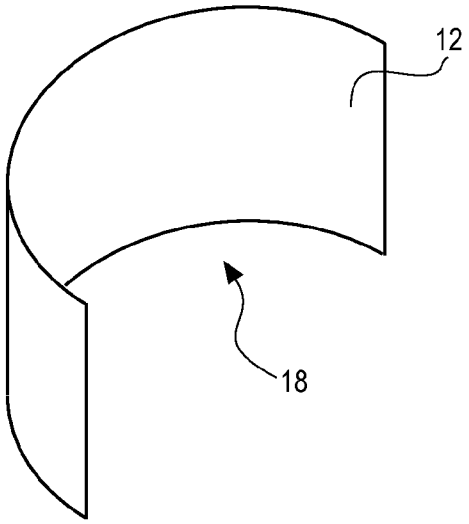
FIGS. 3A and 3B depict shield configurations according to illustrative embodiments of the invention.
Figure 3B:
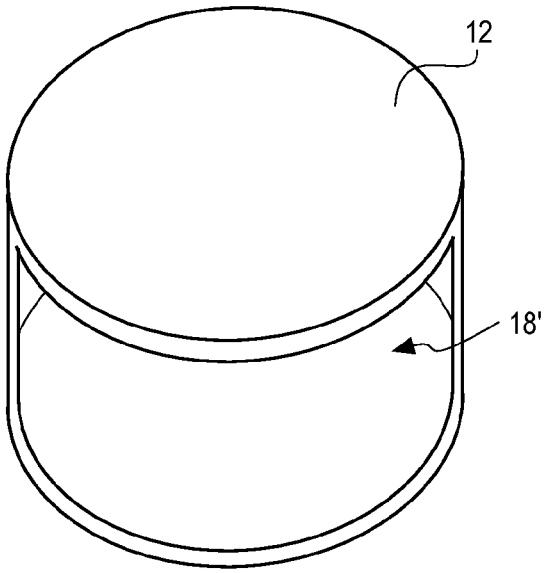

As shown in FIGS. 3A-B, each shield is of a general cylindrical or partial cylindrical shape, with an opening. FIGS. 2A-C depict opening 16 in shield 10 and opening 18 in shield 12 as broken lines. Openings 16, 18 are on the faces of the cylindrical walls and can either extend from the top to the bottom of the cylinder wall as shown in FIG. 3A wherein opening 18 is shown with respect to shield 12, or be a "cut-out" in the cylinder wall such as shown in FIG. 3B by opening 18'. It is noted that either type of opening can be present in shield 10 or 12. Both shields may have the same type of opening or one shield may have an opening extending from the top to the bottom of the shield, such as shown in FIG. 3A, and the other have a window type opening such as shown in FIG. 3B In an exemplary embodiment of the invention, each of shields 10, 12 forms approximately a semi-circle and rotates continuously in the same direction around the structure but at different speeds. This causes shields 10, 12 to form a full "circle" or closed configuration once each day as shown by FIG. 2B. A gap can be seen in FIG. 2B where shields 10 and 12 circumscribe the building, however, it may be advantageous depending on the climate and total building circulation system as a whole to eliminate the gap, so either shields 10 and 12 abut one another, or an additional component such as insulation can be utilized. The differential speed of rotation allows the shields' openings 16, 18 to coincide daily to create a variable aperture, such as shown in FIGS. 2A-C, that both admit direct sunlight (solar insolation) and shade from direct sunlight as well as create closure for insulation purposes that regulate and control temperatures and ventilation, and that may operate other related systems that together serve as a passive solar system. The relative positions of shields 10, 12 create "aperture events" wherein an aperture forms when openings 16, 18 coincide at least partially. FIG. 2A shows a maximum aperture as quantified by $\theta_1$ in this embodiments and FIG. 2C shows an intermediate size aperture quantified by $\theta_2$. The aperture events vary daily and progress seasonally, which results in dynamic regulation of solar insolation, shading and perimeter insulation preferably occurring in proportion to the daily and seasonal average outside temperatures, creating an optimized passive solar conditioning system capable of meeting a building's daily and seasonally space conditioning needs naturally.

Shields 10, 12 can be dimensioned and tailored to a building's location and climate. For example, each shield 10, 12 may extend around at least half of the building's perimeter. For a different location and climate, one or both shields 10, 12 can extend around less than half of the building's perimeter. Shields that extend over greater than half of the perimeter can provide overlap at both ends that can, for example, accommodate insulating materials and assemblies. The extent of overlap can be proportioned to the related assemblies and materials.

In an exemplary embodiment of the invention, the shields are opaque and lightweight and can be driven by one or more low power DC motors along a "track" perimeter to allow the shields to rotate around a perimeter of clearstory or other window types, especially those above eye-level. Other rotation generating configurations can be employed, such as by rotation on an axle. Generally, the shields will rotate continuously. Both shields may be located either inside or outside of a glazing system, and traverse across an approximately flush face of glazing so as to seal to the glazing with a sweeping or brush type seal for insulation closure.

Figure 13:
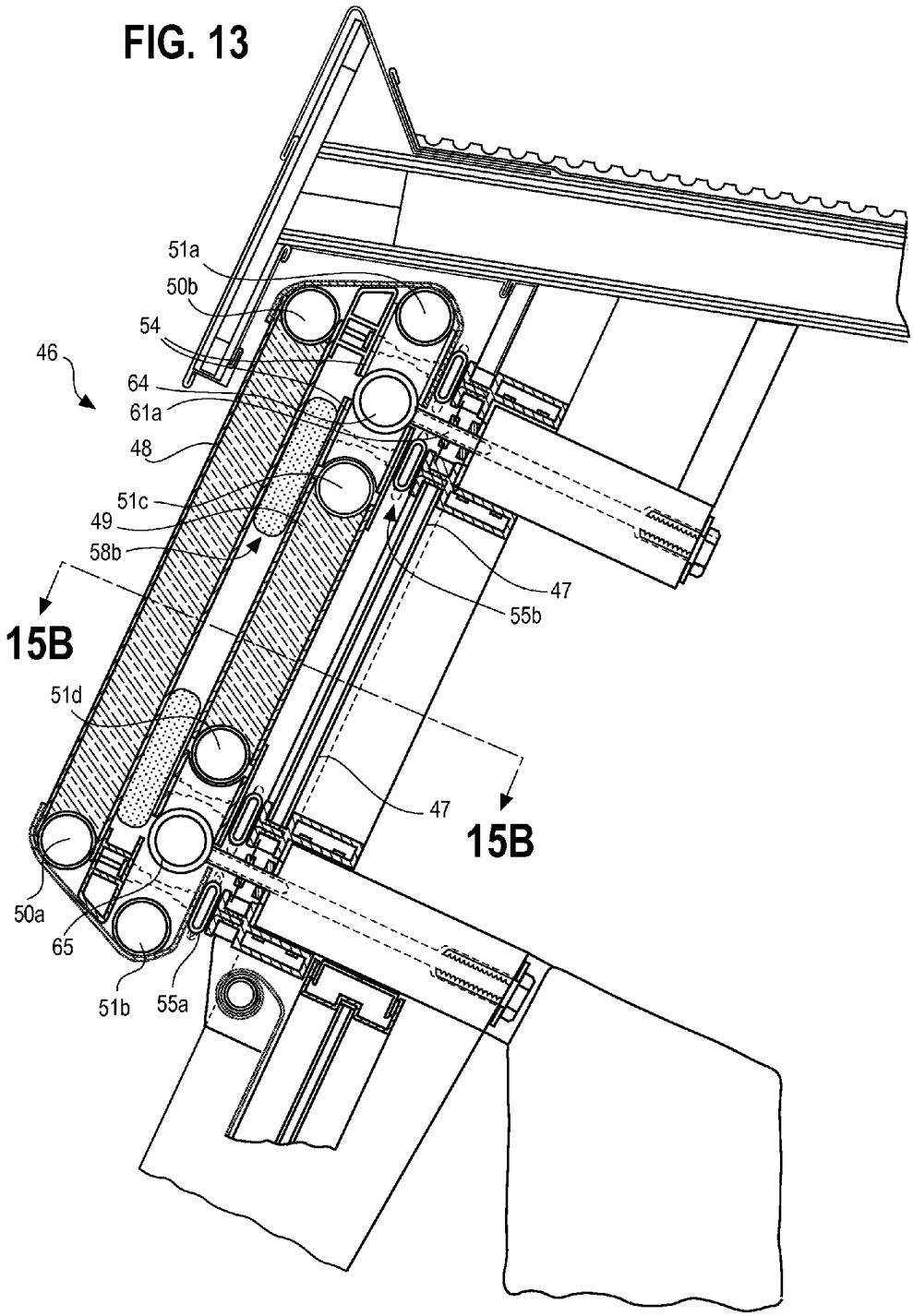
FIG. 13 depicts a longitudinal cross-section of an aperture system according to an illustrative embodiment of the invention.
Figure 14:
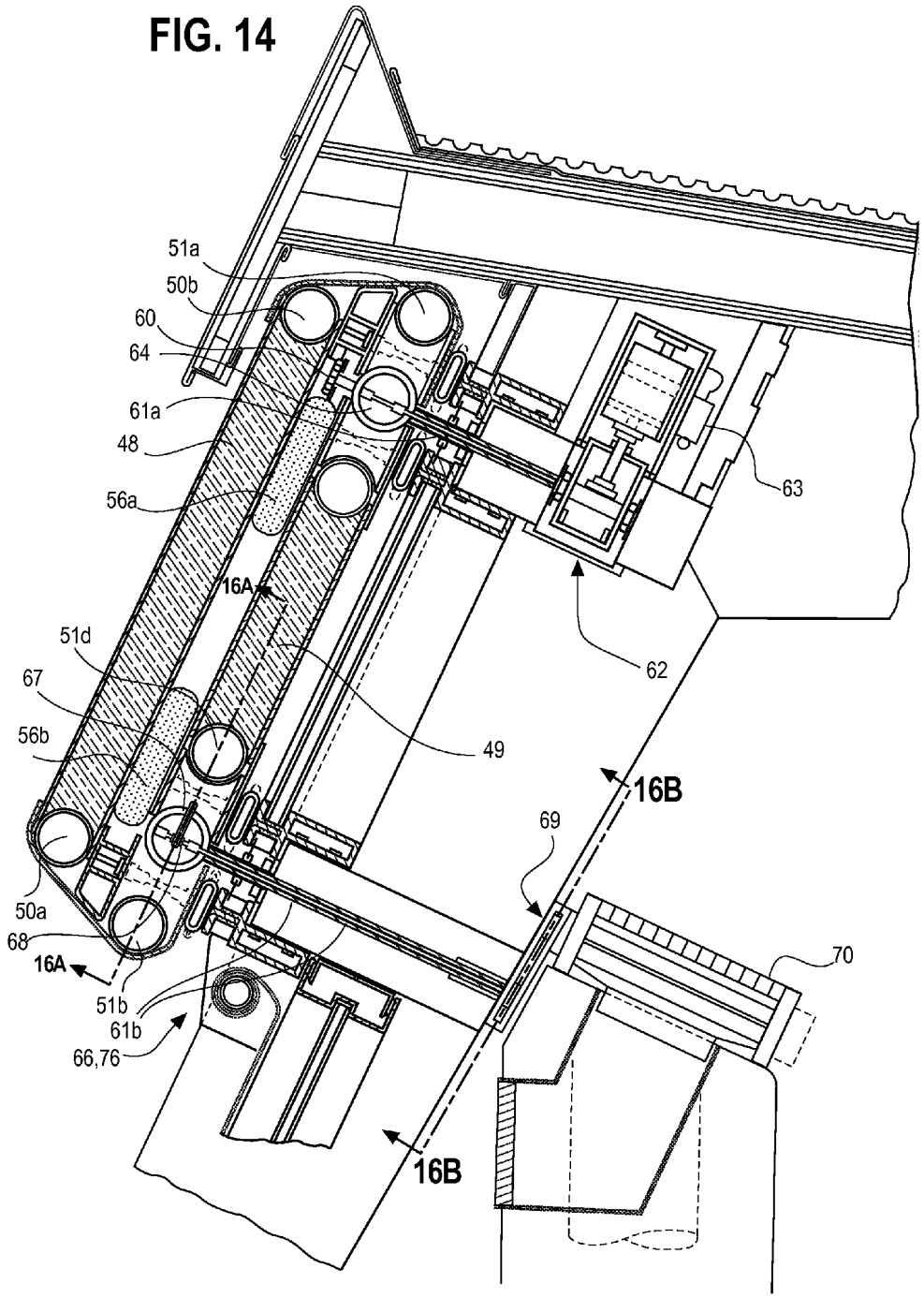
FIG. 14 depicts a longitudinal cross-section of a configuration of portions a ventilation system as implemented in an aperture system according to an illustrative embodiment of the invention.
Figure 17:
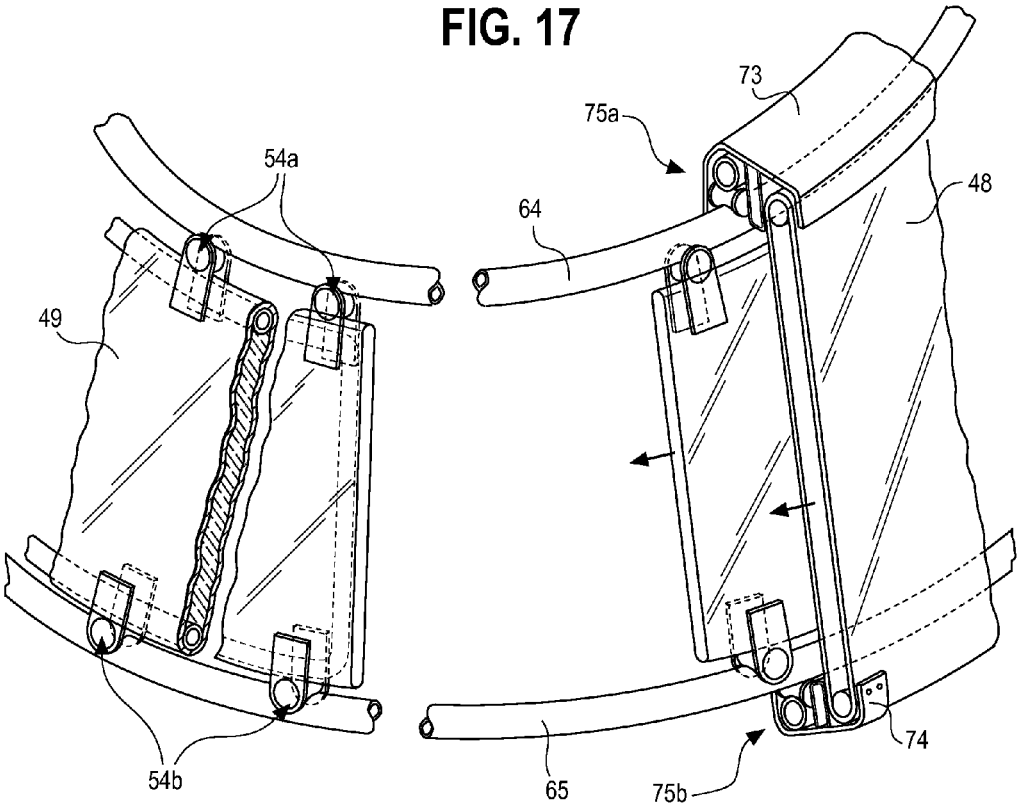
FIG. 17 depicts a partially broken away front isometric view of an aperture system according to an illustrative embodiment of the invention.

FIGS. 13 and 14 depict longitudinal sectional views of a solar aperture apparatus that include components of an actuating assembly according to an illustrative embodiment of the invention. FIG. 17 provides further details of the actuating assembly. The actuating assembly includes a track system along which shields 48, 49 can progress around the building according to an illustrative embodiment of the invention. The aperture apparatus is configured to rotate about a perimeter of a clearstory 46 portion of a building. Clearstory 46 has a plurality of windows, represented here as window 47.

As shown in FIG. 13, the solar energy apparatus includes an outer circadian shield 48 and an inner circannual shield 49, which rotate around clearstory 46. Shields 48, 49 are preferably generally curved to conform to the perimeter of clearstory 46. Shields 48, 49 can include a rigid or non-rigid insulation material such as, for example, fiberglass or foam, and can be constructed as metal-clad insulation panels with aluminum tube framing. Shields 48, 49 may incorporate various strengthening mechanisms to modify their yield strength, ductility, and toughness. Shields 48, 49 may have aluminum tubing 50*a-b* and 51*a-d*, respectively, to provide or add structural support.

In an exemplary embodiment of the invention, the track system includes a horizontal upper rail 64 and a horizontal lower rail 65. Inner shield 49 is disposed between rails 64, 65, whereas outer shield 48 is offset outwardly from rails 64, 65 but functionally engaged via brackets 73, 74. Upper rail 64 may be a load bearing steel pipe circumscribing the perimeter of clearstory 46 and disposed to accommodate the top ends of shields 48, 49. Lower rail 65 is a similar rail and also circumscribes the perimeter of clearstory 46 and is disposed to accommodate the bottom ends of shield 48, 49. Various track systems can be used provided that they adequately support the shields and facilitate desired rotation of the shields about the building. The track system can include dual rails, and may be generally placed along the perimeter of the building, including within the building's walls.

As can be seen in the isometric view of FIG. 17, inner shield 49 includes at least one upper roller assembly 54*a* and one lower roller assembly 54*b*. Roller assemblies 54*a*, 54*b* travel directly along a lower surface of rail 64 and along an upper surface of rail 65 respectively. Outer shield 48 includes at least one upper roller assembly 75*a* and one lower roller assembly 75*b*. Roller assemblies 75*a*, 75*b* include brackets 73, 74, respectively, that house wheel mechanisms that travel along the upper surface of rail 64 and along the lower surface of rail 65 respectively. Roller assemblies 54*a,b*, 75*a,b* can be positioned at various positions along both the upper and lower rails of the track system to facilitate progression of the shields around the building. Roller assemblies 54*a,b*, 75*a,b* can be directly or indirectly connected to either the track system, shields 48, 49, or both. Preferably, each shield includes at least one upper roller assembly and one lower roller assembly.

Referring back to FIG. 13, the track system is secured to the building by one or more securing components, for example, anchors or brackets disposed at various points along the perimeter of the building. FIG. 13 shows the track system anchored at intermittent anchor points along the building's perimeter with anchor rods through the building's perimeter walls. The track system may be spaced a predetermined distance from the perimeter wall of the building to accommodate components such as insulating material. Anchor points 53 can include insulated metal panel infill segments, with gasket seals at each anchor rod building penetration point.

As shown in FIG. 13, the solar energy apparatus can also include shield insulation seals 55*a-b* positioned along the inner surface of inner shield 49 and preferably dimensioned to laterally span all or a substantial portion of inner shield 49 so that seals 55*a-b* may contact the building's perimeter. Seals 55*a-b* can be made of flexible, expandable gasket tubes or wool pile seals or other suitable sealing material such that the release of thermal energy by free convection and/or thermal radiation is minimized when seals 55*a-b* are in contact with the building.

Figure 15C:
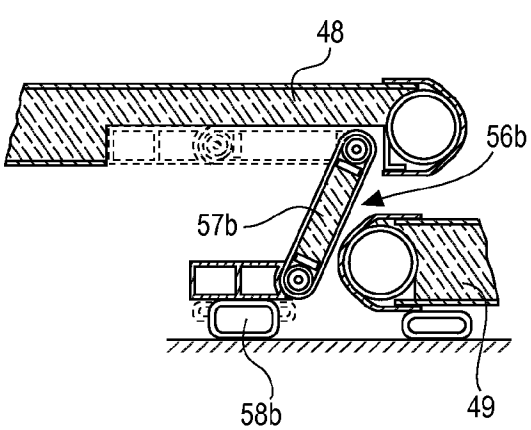
FIGS. 15A-C are cross-sectional views of the solar energy apparatus of FIG. 13 taken along the line 15B-15B illustrating the operation of the apparatus at varying stages.
Figure 15B:
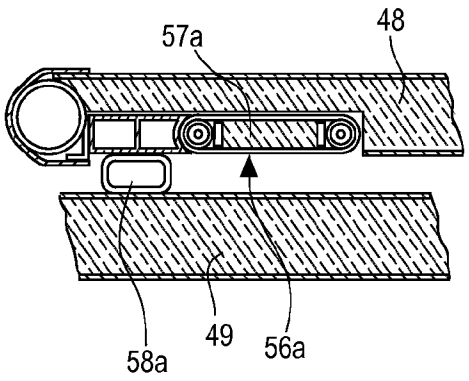
Figure 15A:
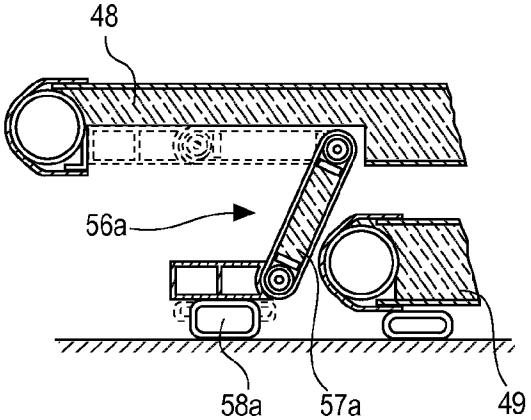

FIGS. 15A-C are cross-sectional views of the solar energy apparatus of FIG. 13 taken along the line 15B-15B illustrating the operation of the solar energy apparatus at various stages. They depict the functioning of articulating seals 56*a-b* according to an illustrative embodiment of the invention. Articulating seals 56*a-b* are disposed between shields 48 and 49 as can be seen in FIG. 13 by noting the articulating seals' gaskets 58*a,b*. Articulating seals 56*a,b* generally will provide the most benefit by being positioned at the longitudinal and lateral proximal ends of shields 48, 49 and dimensioned to laterally span a substantial portion of the shields 48, 49.

Inner shield 48 and outer shield 49 move at different speeds, so their relative position continually changes. Articulating seals 56*a,b* are designed to maintain a seal regardless of the relative position of shields 48, 49. FIG. 15A shows arm 57*a* pivoted away from outer shield 48. A gasket 58*a* is disposed at a proximal end of arm 57*a*. Arm 57*a* is biased via a biasing component such as a spring so that when inner shield 49 does not span articulating seal 56*a*, arm 57*a* automatically pivots or otherwise extends away from outer shield 48 such that a "gasket" 58*a*, shown here as a flexible and expandable tube, contacts the building surface, thereby maintaining the seal. Arm 57*a* is of sufficient length to assure that gasket 58*a* contacts the building when shield 49 is not spanning articulating seal 56*a*. Other gasket materials and configurations of components can serve as the "gasket" provided they maintain contact with either inner shield 49 or the building as shields 48, 49 change position with respect to one another.

FIG. 15B depicts the configuration of articulating seal 56*a* when inner shield 49 spans articulating seal 56*a*. In this situation arm 57*a* is forced toward outer shield 48 so that gasket 58*a* maintains a seal between outer shield 48 and inner shield 49, FIG. 15C depicts articulating seal 56*b*, which is laterally positioned elsewhere along outer shield 48, but functions in the same manner as articulating seal 56*a*. Articulating seal 56*b* has arm 57*b* and gasket 58*b*. In FIG. 15C outer shield 48 is just approaching inner shield 49 which will cause arm 57*b* to pivot toward outer shield 48 such that gasket 58*b* will be forced against the outer surface of inner shield 49.

A propulsion assembly causes shields 48, 49 to progress around the building, and can be designed to function both in a forward and reverse manner. Propulsion assemblies can be powered for example by electric, gas or solar powered motors. The propulsion assembly may directly drive shields 48, 49, or drive one or more additional components attached directly or indirectly to the shields. Propulsion assemblies can be controlled by switches, voice-activation, key-pads, or other devices functionally connected to the actuating assembly to turn it on and off, and vary other actuating parameters.

FIG. 14 includes a propulsion assembly according to an illustrative embodiment. The propulsion assembly is functionally attached to the track system to drive shields 48, 49 along the track. The propulsion assembly includes at least one geared drive wheel 60 configured and disposed to functionally engage drive teeth that are incorporated into shields 48,49 to move them along the track. The drive teeth can be, for example, incorporated into the shields as continuous toothed strips and located so that they can be engaged with the geared drive wheel. Geared drive wheels 60 rotate about associated axles 61*a* b. Geared drive wheels and associated axles are further connected to a single interior gear drive box 62 inset within the building. Interior gear drive box 62 includes a rotation drive motor 63. A control component, such as a computer or microprocessor programmed to cause shields 48, 49 to progress in a selected or desired manner can be included. The control component, which is functionally connected to the motor 63, can be housed within gear drive box 62 or external to it. Embodiments of the invention may also include an electronic stabilization mechanism and/or an electronic speed limitation device. Electronic safety devices can also be included, such as obstacle recognition and associated alarm systems.

The Solar Aperture Daily Cycle Events

The solar aperture's continual rotation creates daily aperture opening and closing events at appropriate times of the day when the openings in the shields bypass each other due to their rotational speed differential. Aperture size, such as shown for example by $\theta_1$ and $\theta_2$ in FIGS. 2A and 2C, respectively, increases gradually throughout the day to its largest at approximately midday allowing either maximum solar insolation, daylighting or shading based on the season, and decreases toward days end to close the insulation perimeter to maximize the dynamic insulation value when needed most. The aperture rotates in a clockwise direction to track with or away from the suns path depending on the season. This daily aperture cycle regulates passive solar and other events in proportion to the daily average outside temperature, and therefore in proportion to the parent structures daily average conditioning needs.

Figure 4:
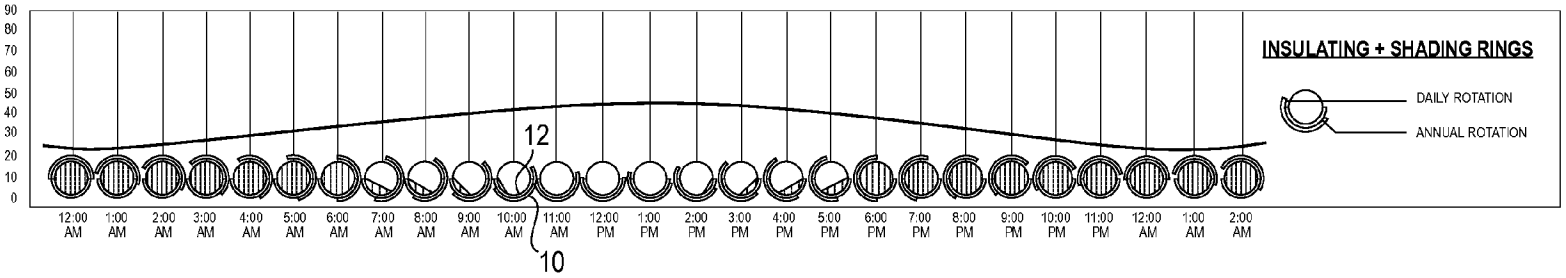
FIG. 4 shows aperture events in relation to average outside temperatures throughout a winter day according to an illustrative embodiment of the invention.

FIG. 4 represents an illustrative daily aperture cycle which shows shield positions throughout an average day in midwinter, and depicts maximization and tracking of solar exposure and insulation perimeter closure resulting from the aperture events operating in proportion to the daily average outside temperature. In FIG. 4 outer shield 10 is a "circadian" shield having a rotational frequency based on a day and inner shield 12 is a "circannual" shield having a rotational frequency based on a year.

The Solar Aperture Seasonal Cycle Events

The solar aperture's daily opening events also occur at continually varying positions around the perimeter relative to the position of the sun to accurately regulate the amount of solar insolation and shading relative to the season variation. The position of the daily aperture midpoint at noon advances slowly throughout the year due to the shields' speed and number of rotations. As the seasons progress toward winter, the advancing aperture position admits an increasing amount of direct sunlight each day until the maximum amount occurs at the coldest point in an average year. Conversely, as the seasons progress toward summer, the advancing aperture position provides an increasing amount of shade and decreasing direct sunlight while maintaining maximum daylight until the maximum amount of shade and minimum amount of direct sun light occurs at the hottest point in an average year. This seasonal aperture cycle regulates passive solar and other events in proportion to the seasonal average outside temperature, and therefore in proportion to the parent structure's seasonal average conditioning needs.

Figure 5:
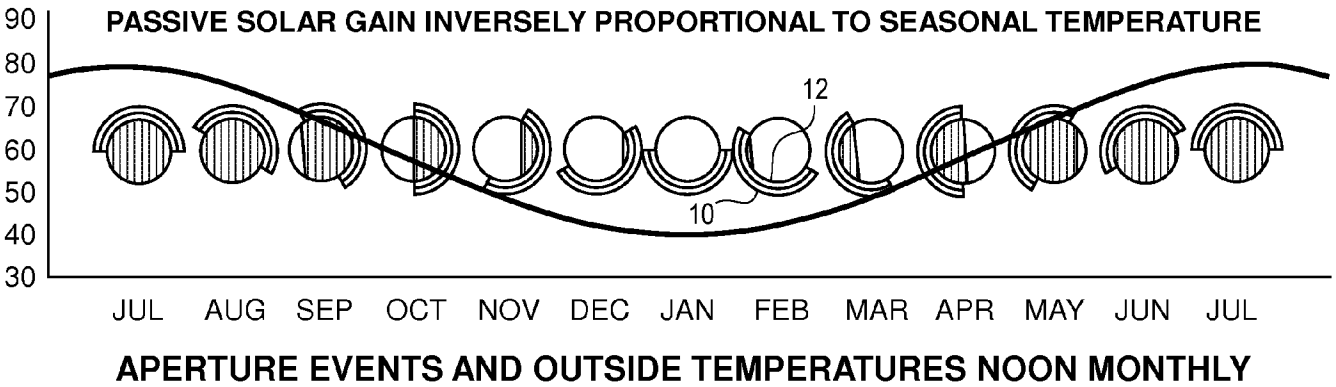
FIG. 5 shows monthly aperture events in relation to average outside temperatures at noon according to an illustrative embodiment of the invention.
Figure 6A:
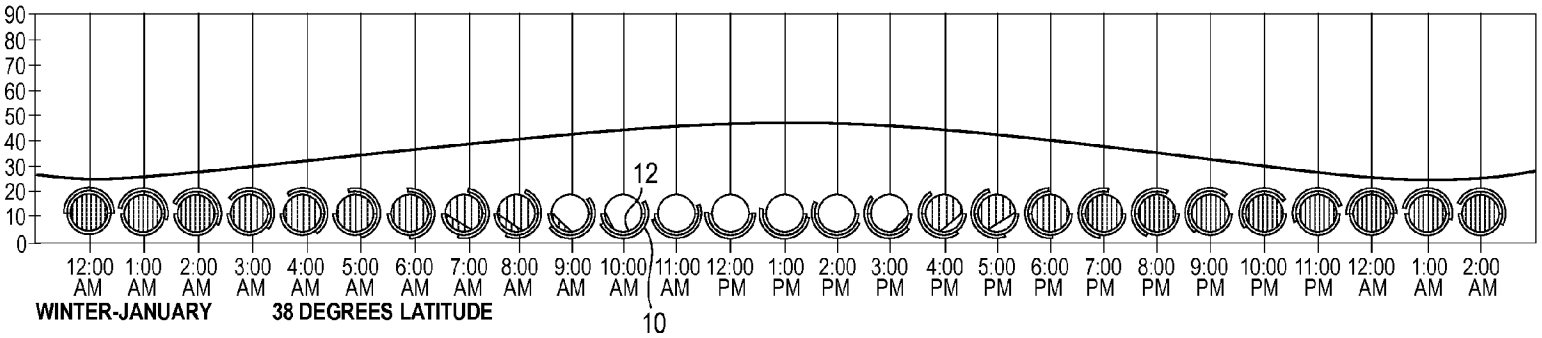
FIGS. 6A-D show aperture events in relation to outside temperatures throughout a day on a seasonal basis according to an illustrative embodiment of the invention.
Figure 6B:
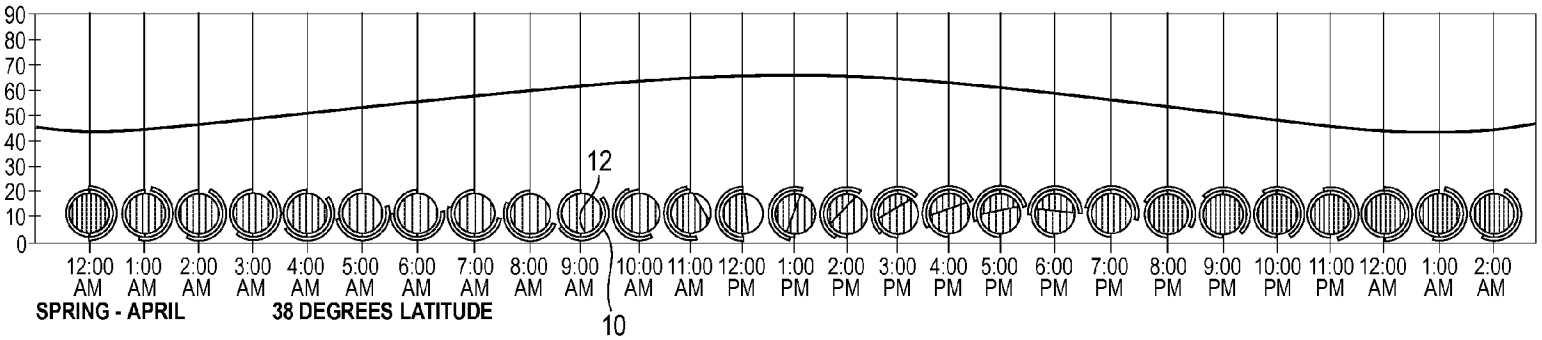
Figure 6C:
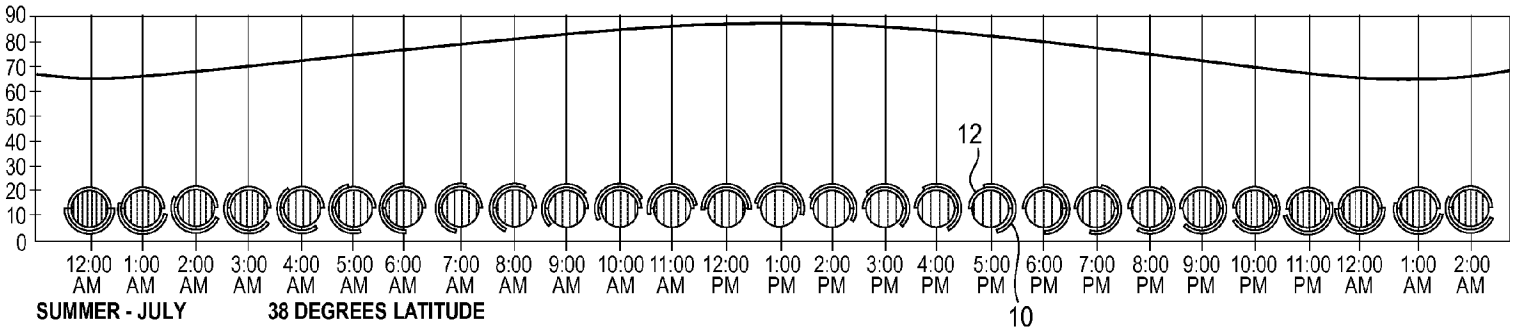
Figure 6D:
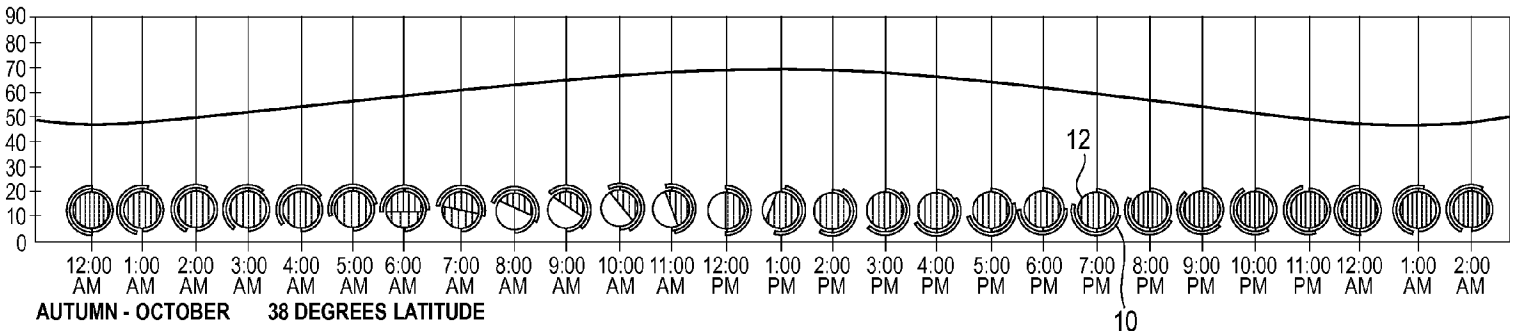

The seasonal aperture cycle is represented in FIG. 5, which shows shield positions at midday on an average day for each month throughout one year, and illustrates the sun, shade and daylight amounts at midday resulting from the aperture events which are inversely proportional to the seasonal average outside temperature. In FIG. 5 outer shield 10 is the "circadian" shield and inner shield 12 is the "circannual" shield.

Dynamic Interaction of the Daily and Seasonal Aperture Shields

A continual passive aperture event dynamic results from the rotational speed differential between the two shields. Their relationship preferably mimics that of the earth and sun in general, and more specifically the dynamic of the earth's daily rotation and its annual orbit around the sun. The same planetary scale dynamic that causes our daily and seasonal temperature change patterns is effectively reproduced by the solar aperture with event patterns occurring in unison with these temperature change patterns.

It is noted that the term "year" refers to a period of about 365¼ solar days required for one revolution of the earth around the sun, as opposed to a calendar year which can be 365 or 366 days. In general, the system preferably emulates the relative motion of the earth and sun and is thus set to solar-time. It is possible though to have the system based on a calendar year with the means to adjust it according to the discrepancy between the calendar and solar-time.

According to an exemplary embodiment of the invention, the first of the shields in the system, each for example having a half-circle opening, preferably completes exactly one rotation per year mimicking the annual orbit of the earth around the sun. As a mechanical device, the system may vary slightly from one full rotation per year, and therefore, can be either manually or automatically adjusted if necessary. This is the circannual rhythm ring or shield and provides seasonal gross exposure regulation. Its opening midpoint is oriented to the south at the coldest average temperature point in the year which allows maximum solar gain. Its gradual rotation results in its opening reorienting itself 180 degrees to the north about six months later at the hottest average temperature point in the year, which preferably provides maximum shade while allowing full northern daylight. The remaining points throughout the year provide gradually varying gross exposures that remain proportional to the season's varying temperatures.

The second of the shields in the system completes approximately one rotation per day mimicking the daily rotation of the earth on its axis. This is the circadian rhythm shield and provides daily gross exposure regulation. Its opening midpoint is also oriented to the south, such as at noon on the coldest average temperature point during the year, while its clockwise rotation tracks with the sun's path throughout the day to maximize direct sun exposure in winter. The combination of the circadian shield's daily rotation with the relatively fixed circannual shield's rotation results in a combined aperture that increases gradually throughout the day to a maximum size, such as at noon or other selected time, and gradually decreases toward the evening to close at night. This daily aperture event cycle serves to regulate the amount of sun and daylight admitted and creates a dynamic insulation perimeter that increases its effective value as the sun sets when solar gain is less than convection losses. It closes each night when insulation is needed most, which can be important in a passive solar heat storage system. It is noted that the circadian shield can be either the inner shield 12 or the outer shield 10.

The circadian shield completes slightly more than one rotation a day turning approximately 361 degrees. This advances the shield's opening midpoint clockwise each day to achieve approximately 365 different positions throughout the year by completing approximately 366 rotations annually which creates evolving aperture events appropriately oriented and timed in response to seasonal temperature change and varying sun positions. The aperture midpoint is oriented south in winter and its width increases throughout the day to track the sun for maximum solar gain and then decreases and closes at night. Its gradual daily rotational gain combined with the advancing midpoint of the circannual shield results in the aperture's midpoint slowly reorienting itself to the north about six months later at the hottest average temperature point in the year when the dynamic aperture provides maximum shade throughout the day as it tracks away from the sun while allowing an optimal amount of northern daylight.

These aperture event dynamics continue in a perpetual clock-like fashion in proportion to the daily and seasonal temperature change patterns. Daily rotational progress toward the summer solstice results in proportionately more shade and less direct sunlight received each day, with the opposite occurring when progressing away from summer. Daily rotational progress toward the winter solstice results in proportionately more direct sunlight received each day, with the opposite occurring when progressing away from winter. The passive interaction of the circadian and circannual shields creates dynamic aperture events that remain in proportion to average external temperatures, thereby enabling it to satisfy a structure's average demands for sun exposure, shade, ventilation and insulation closure both daily and seasonally as a comprehensive passive dynamic solar energy system.

FIGS. 6A-D depict the seasonal aperture cycle, which illustrates the resulting amounts of shading and direct solar gain regulated throughout an average day of each of four seasons by the solar aperture system. Temperatures used are generally the average per hour per typical day of each month. Temperature range spikes and variants are simplified, smoothed out, and normalized to a sine wave supporting oscillation concept overall. Averages are determined by historical data. The continuous dynamic interaction between the two shields is shown to be operating in proportion to the hourly average outside temperature throughout a day and evolves as the seasons progress such that the winter and summer seasons receive the maximum and minimum possible amounts of direct gain, respectively, while the spring and autumn seasons receive approximately half that amount. In FIGS. 6A-D outer shield 10 is the circadian shield and inner shield 12 is the circannual shield.

Figure 7:
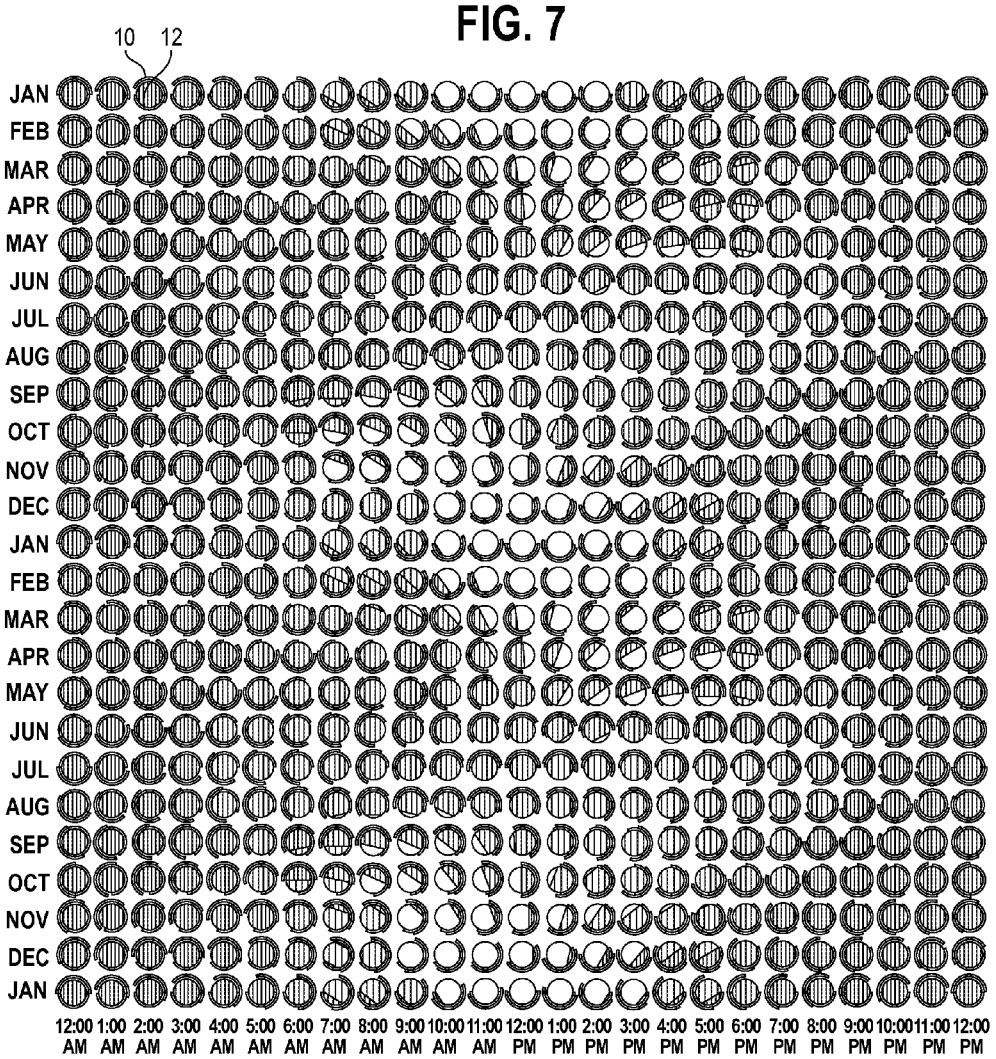
FIG. 7 shows aperture events on a typical day per month over a two year period according to an illustrative embodiment of the invention.

FIG. 7 depicts both the daily and seasonal aperture cycle more completely which illustrates the resulting aperture events occurring throughout a typical day of each month for a two year period in a calendar-like fashion where the seasonal and hourly waxing and waning is more apparent. In FIG. 7 outer shield 10 is the circadian shield and inner shield 12 is the circannual shield.

Solar Aperture Alignment with Temperature Cycles

The shields of the aperture system must be properly oriented and set in motion to be responsive to or follow the average daily and seasonal outside temperatures in accordance with a structure's location. The amount and direction of direct sun varies throughout each day and season and is dependent upon the latitude in which the structure is located. To establish the systems event cycles, the yearly and daily temperature rhythms of the given location are superimposed over the rhythms of the aperture events, which can be calibrated and aligned for maximum coincidence and efficiency.

The dynamic solar aperture seasonal events occur in proportion to average outside temperatures by creating aperture size and location that admit the maximum and minimum amounts of direct sun at the coldest and hottest points in the year, respectively, with a midlevel amount admitted at midpoints between the two. These four points of the calendar if imposed upon a twelve month clock face would generally occur at the seasonal equinoxes and solstices and can be represented, for example, at noon, three, six and nine o'clock as the seasonal cardinal points.

The dynamic solar aperture daily events also occur in proportion to average maximum and minimum temperature cycles throughout the day, which if imposed upon a 24 hour clock face would generally occur at midday and midnight as the daily cardinal points. Superimposing the seasonal and daily event cycles allows adjustment for improved efficiency by alignment with actual average temperature cycles. In general, the daily maximum temperature occurs some hours after noon at approximately two o'clock. The opposite occurs at night with colder temperature reached well after midnight. A similar temperature pattern occurs seasonally as well with the hottest point in a year occurring a month after the "center of the year" or summer solstice and the coldest a month after the winter solstice. These points represent the real-time peaks of supply and demand and are aligned to most efficiently balance the two. Note that designations of time are approximate. Variables such as day light savings time and leap year are irrelevant to the system operation which emulates the earth-sun relationship and is set by real solar-time.

In an illustrative method, the initial alignment of openings in the circadian and circannual shield perimeters is set to coincide at these locally adjusted cardinal points to establish the most efficient event system which is capable of further adjustment. Adjustments to aperture size of either shield, or biasing toward the east or west of south allows the system to be customized further for a particular latitude or location and tuned for optimal spring and autumn performance. During such adjustment, the moment of insulation perimeter closure may be trimmed to better balance heat gains and losses throughout a day and each season. This may optimize the dynamic events to create an effective passive system, possibly without the complexities of most active/dynamic systems. Ideally, the motion of the two shields, once oriented and set in motion, become the heart of a passive solar energy system capable of satisfying the mean heating and cooling requirements of a structure at any moment and with respect to its location. The system thus may satisfy a dynamic demand in a manner emulating an inversion of the earth-sun relationship.

Figure 8:
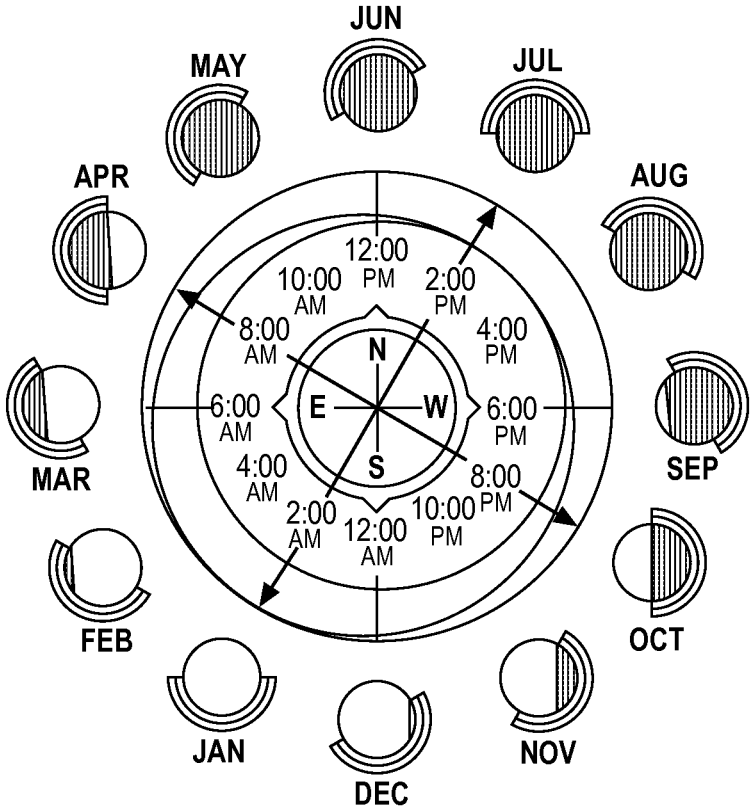
FIG. 8 shows a daily and seasonal temperature cycle clock according to an illustrative embodiment of the invention.

FIG. 8 depicts an "aperture clock" according to an illustrative embodiment of the invention, showing the superimposition and alignment of daily and seasonal average temperature cycles and their extremes to determine the time of day and month in a year to which the aperture shield openings are to be coordinated. It is used in design for calibration of aperture size, orientation, biasing and closure moments. This illustrates that the extremes occur past the solstices and daily midpoints and establishes the initial orientation of the shields for a particular location. In an exemplary embodiment as shown in the diagrams, the system is calibrated for performance in the northern hemisphere at 38 degrees of latitude. The center of the aperture event-year is set to January, which balances the entirety of seasonal and daily events with the temperature demand.

Dynamic Ventilation Control by the Aperture System

An ideal passive solar system not only heats, shades and lights a structure, but drives building ventilation, air circulation, and passive cooling systems as part of a comprehensive conditioning system. The solar aperture system accomplish this passively and dynamically by actuating ventilation and air movement in proportion to the average seasonal and daily outside temperatures during its seasonal and daily rotations. The aperture system is a passive yet active multipurpose system capable of serving as the heart of a living and breathing building.

An illustrative embodiment of a comprehensive conditioning system can be described as follows: The annual rotation of the circannual shield may regulate gross building ventilation in proportion to the seasonally varying outside temperatures by operating ventilation portals around the building perimeter throughout the year. Various types of portals may be included, such as those shown for example and identified in FIGS. 9-12, discussed further below. In summer the advancement of the circannual shield is capable of opening an increasing number of outside air, ground-coupled air, or other sorts of cooling ventilation portals which increase the building's gross cooling capacity such that at the hottest point in the season the maximum number of cooling ventilation portals are opened. As the circannual shield passes by progressing toward the cooler seasons, these portals are closed off gradually. In winter the advancement of the circannual shield is capable of opening an increasing number of solarium, trombe wall, greenhouse, or other sorts of warming ventilation portals that increase the building's gross heating capacity such that at the coldest point in the season the maximum number of warming ventilation portals are opened. As the circannual shield passes by progressing toward the warmer seasons, these portals are closed off gradually. The advancement of the circannual shield during the spring and autumn seasons transitions the ventilation opening ratio away from a predominantly warming or cooling mode to a blending of warming and cooling ventilation portals that allows either to be utilized as needed while the ratio remains proportional to the outside temperatures. The circannual shield's action creates a seasonal ventilation cycle with the same dynamic response to outside temperature averages as the seasonal aperture cycle.

The daily rotation of the circadian shield further regulates building ventilation in proportion to the daily cycle of outside temperatures by operating internal building ventilation and circulation portals supplied by the seasonally operated building perimeter gross ventilation ports. In the morning hours during winter as solar insolation heats up solar chimneys, solariums, trombe walls, or other warming spaces, the advancement of the circadian shield is capable of gradually opening a number of internal circulation portals to supply warming air to building spaces, and to drive warm air exhaust and cooling air intake in the summer such that at the warmest point in the day some hours afternoon the maximum volume is allowed to circulate or exhaust. In the evening hours during winter as solar gains diminish and reverse, the advancement of the circadian shield is capable of gradually closing circulation portals to insulate and direct radiant heat, and to purge heat and draw upon pooled and conditioned cooling air in the summer such that at the coldest point in the night some hours after midnight the minimum volume is allowed to circulate. The circadian shield's action creates a daily ventilation cycle with the same dynamic response to outside temperature averages as the daily aperture cycle.

The operation of ventilation and circulation portals can be actuated by leading or trailing edges of the shields or by linear bars or tabs along a shield's perimeter, which engage mechanical cams, levers, plungers, electrical actuators or sensors, or other "switch" mechanism along the shield's rails or tracks or other actuating assembly. In a particular embodiment of the invention, a continual series of portals along the perimeter are closed while a shield is traveling over it and is opened as it passes by, with the seasonal portals opening for some number of months serving as gross portals, and the daily portals opening for some number of hours serving as on-demand portals within, or concentric to the seasonal portals.

Figure 2D:
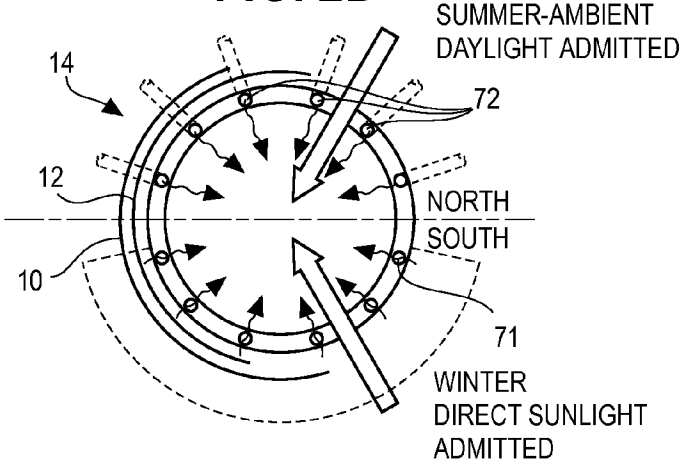

FIG. 2D schematically depicts the solar aperture system shown in FIGS. 2A-D further including ventilation portals 71, 72 disposed along the perimeter of building 14. In this particular embodiment, six ventilation cooling portals 71 are placed along the northern half of the building's perimeter and six ventilation warming portals 72 are placed along the southern half of the building's perimeter. Cooling portals 71 can be configured to function alone or in conjunction with additional components for regulating cooling capacity such as ground-coupled cooling air tubes. Similarly, warming portals 72 can be configured to function alone or in conjunction with additional components for regulating heating capacity around and within the building such as solariums or mass walls.

Figure 16A:
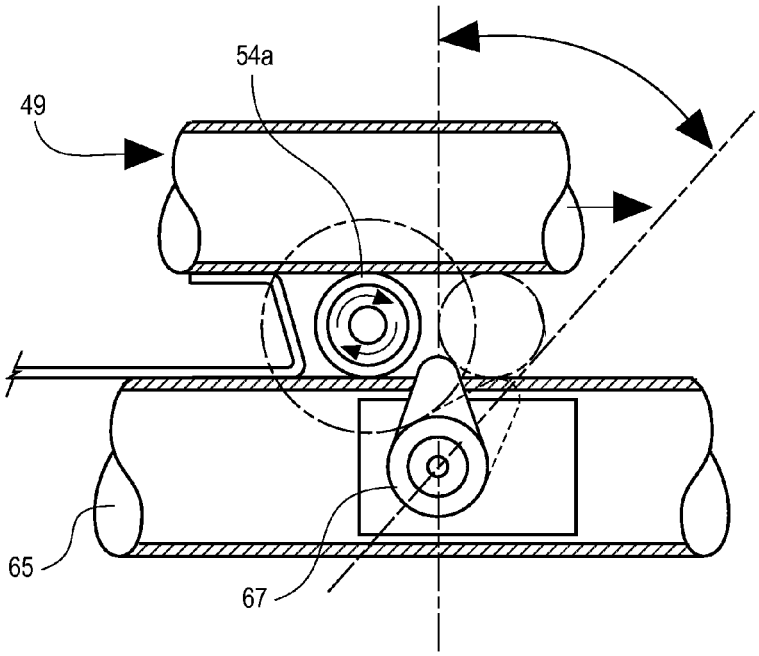
FIGS. 16A-B are cross-sectional views of the solar energy apparatus shown in FIG. 14 taken along the lines 16A-16A and 16B-16B, respectively.

FIG. 14 shows a portion of a ventilation system according to an illustrative embodiment. FIG. 16A is a cross-sectional view of an inner shield operated portal engaging assembly as shown in FIG. 14 taken along the line 16A-16A. The ventilation system includes at least one portal engaging assembly 66 activated by inner shield 49 and at least one portal engaging assembly 76 activated by the outer shield 48. Portal engaging assemblies 66, 76 are functionally coupled to bottom track 65 at various points along the track. In this illustrative embodiment, each portal engaging assembly includes a cam 67 coupled to a camshaft 68 that is further coupled to a portal controller component 69. Each cam 67 pivots about camshaft 68 housed in a tube extending substantially orthogonally away from bottom track 65 and into the interior of clearstory 46. Cam 67 extends above lower track 65. Lower roller assembly 54*b* of inner shield 49 actuates portal engaging assembly 66 by pressing on cam 67 as lower roller assembly 54*b* rolls over it. Outer shield portal engaging assembly 76 is disposed on lower track 65 such that its cam 67 extends below lower track 65 and can be engaged by lower roller assembly 75*b* of outer shield 48 in a similar manner to its counterpart.

Figure 16B:
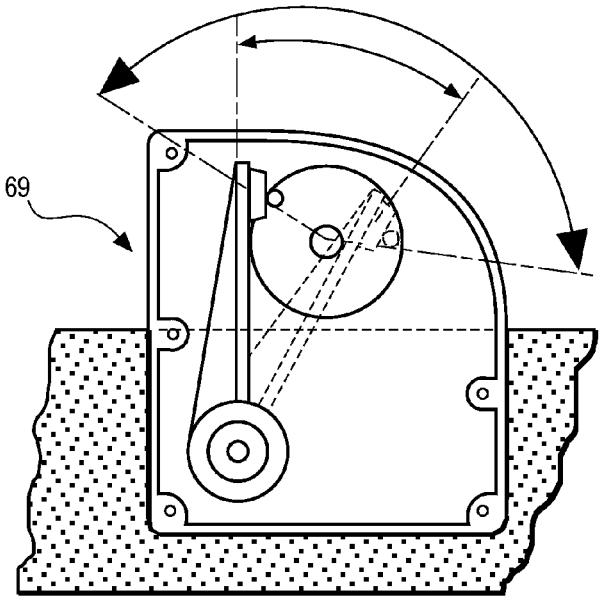

Referring back to FIG. 14, camshaft 68 is in turn coupled to a portal controller component 69 inset within the building that is further operably coupled to at least one ventilation component, circulation component or a combination thereof. FIG. 16B is a cross-sectional view of an illustrative portal controller component as shown in FIG. 14 taken along the line 16B-16B. Such ventilation or circulation components can include, but are not limited to, through-wall air duct portals, solarium-air source ducts for winter heating, or ground-coupled air tubes for summer cooling. Controller component 69 utilizes the rotation of camshaft 68 to operate a ventilation or circulation component to which it is attached. For example, outer shield 48 is coupled to portal controller component 69 which operates dampers 70 mounted on top of air ducts within bearing walls to fulfill the building's daily ventilation system needs. Inner shield 49 can be coupled to a portal controller component which operates vertically oriented rods to control cool air plenum portals for seasonal ventilation control.

Solar Clock and Calendar Formed by Aperture System

In an illustrative embodiment of the invention, the perpetual clock-like rotation of the solar aperture can be visible to a structure's occupants, and its enveloping nature can impart an intimate awareness of solar-time, natural cycles, and the earth-sun relationship acting as a biophilic design element. The shields can create a large overhead perpetual calendar and 24-hour clock as well as a celestial and seasonal event marker system that presents a constant reference of real sun-time. A 24 hour clock is created with a fixed mark, pointer or other indicator on the circannual shield that points to hour and minute markings on the circadian shield that bypass continually. The 24 hour clock can also be created with a fixed mark, pointer, or other indicator on the circadian shield pointing to hour and minute markings on the circannual shield. A perpetual calendar is created with a fixed mark, pointer or other indicator on the structure pointing to daily, monthly and seasonal markings on the circannual ring that bypass continually. The perpetual calendar can also be created with the fixed mark, pointer or other indicator placed on the circannual ring pointing to daily, monthly and seasonal markings on the structure. Seasonal events such as the equinoxes and solstices can be indicated between the shields and structure directly or with precise holes in the shields to admit direct sun rays targeting indicators beyond that mark rising and setting events similar to ancient memorial systems.

Further Description of Components that can Work in Concert

The solar aperture apparatus can be used with any combination of the following elements to further regulate the conditioning of a building.

- Mass wall/floor storage: Core and perimeter masonry or concrete walls or floors can be sized to absorb and release radiant heat both daily and seasonally, preconditioning air circulation within, and extending regulation of temperatures through the day and overnight.
- Solarium or greenhouse: Lining the south façade of all or a portion of a building's length or perimeter, solarium or greenhouse volumes can precondition air and become a component of the air ventilation and circulation engine, and buffer the interior from seasonal extremes.
- Trombe wall/Solar chimney: Core or perimeter mass walls release heat gained from the sun to function as an air circulation and exhaust engine year round to drive air currents, release radiant heat, and distribute controlled daylight to the core of the building.

Natural ventilation and circulation: A networked ventilation system may allow the mass and trombe walls and solar chimneys to circulate and exhaust air as needed driven by temperature differentials which can be boosted and or cooled by ground coupled fresh air intake portals that can also be driven by the gravity of cool air from shaded areas or areas elevated by a site's terrain.

Air distribution: Natural and fan driven air circulation through core and perimeter mass walls can be regulated seasonally through a plurality of operable ventilation portals along the building's circumference which are actuated by the passing of the rings or shields which adds or subtracts ground-coupled air tubes and solarium ventilation ports to or from the building ventilation system in proportion to seasonal or daily needs.

Daylighting: The aperture system may automatically control substantial amounts of daylight into open spaces both daily and seasonally. Light quality and direction can be matched to the seasons with selective admittance of northern cooling ambient light in summer, southern warming rays in winter, and balanced east and west light in the spring and fall.

In an illustrative embodiment of the invention, the building includes a clearstory glazing system for solar energy gain and daylighting that utilizes the solar aperture system for regulation, shading, insulation and ventilation and air circulation control. "Clearstory" is used herein broadly and can include various configurations of windows that satisfy the solar energy and lighting requirements. FIGS. 9 and 10 depict an illustrative embodiment of an aperture system applied to a building form surrounding clearstory fenestration as implemented in the winter in the northern hemisphere where heating of the building is generally desirable. FIG. 9 depicts a south-north building cross section.

In the winter, the solar aperture regulates sunlight at the south side of the building, providing heating, and regulates air circulation. The elements numerated in the illustrative example shown in FIGS. 9 and 10 are as follows: South facing clearstory 20 has an open aperture tracking and admitting full sun for optimal solar gain and preferably complete night closure for optimum insulation. North facing clearstory 21 is not subject to an open aperture to supply optimal insulation. Thermal mass wall 22 can preheat air circulation within the wall and release heat at night. Trombe wall solar chimney 23 can allow a warm air high point return. Arrows 24 show a warm air return route through mass wall 22 providing a top-down circulation drawn by plenum recirculation. Operable ventilation panels and light monitors are shown by reference number 25. Air distribution and humidification plenum 26(7) is provided to distribute conditioned air from areas such as a greenhouse across the structure and to higher levels. A solar heat portal 27 is provided that is controlled daily and seasonally by the clearstory aperture. Solarium/greenhouse 28 can collect heat for distribution to atriums via automatic portals, thus driving circulation. In-floor warm air supply/distribution 29(10) may also be included. Daylighting is supplied over and through mass wall portals 30(11). A light monitor 31 provides indirect daylighting. Arrow 32 indicates outside and make-up air entering the system.

Figure 12:
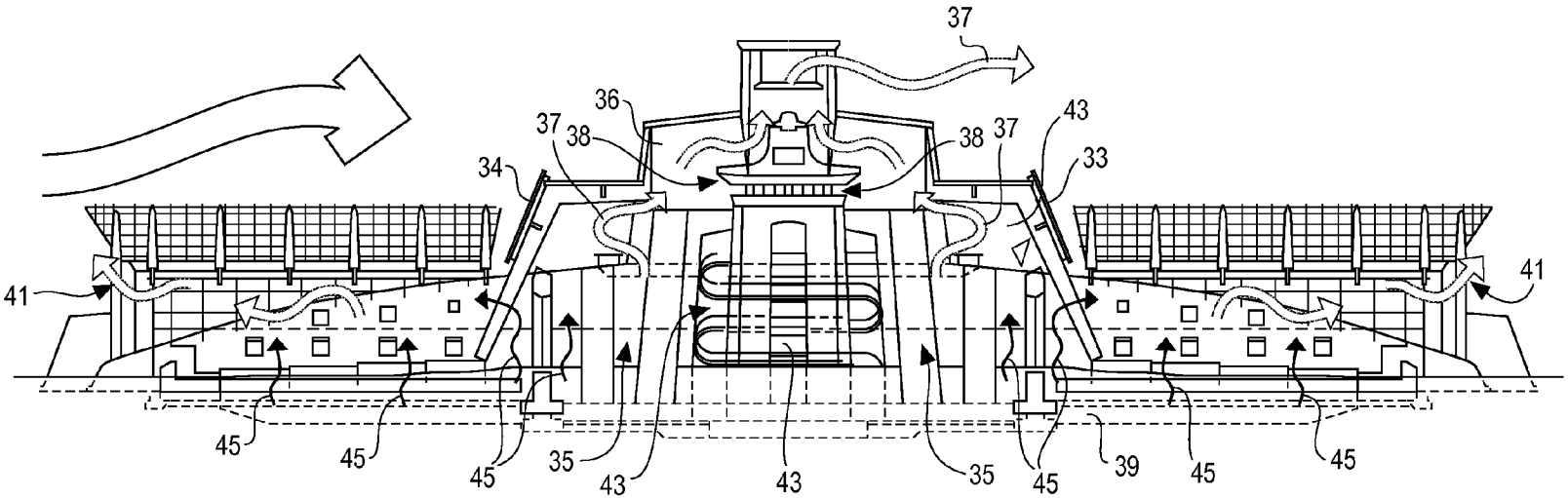
FIG. 12 depicts an east-west cross section of a building as implemented in the summer in the northern hemisphere according to an illustrative embodiment of the invention

FIGS. 11 and 12 depict an illustrative embodiment of a configuration of the system as implemented in the summer, wherein cooling is generally desirable. FIG. 11 is a south-north cross section of the building.

In the summer, the aperture regulates daylighting at the north side of the building, and regulates cool air from below the ground drawn from shaded elevated areas and is distributed throughout the building while hot air is regulated and exhausted above. The elements numerated in the illustrative example shown in FIGS. 11 and 12 are as follows: North facing clearstory 33 has an open aperture tracking full daylight. South facing clearstory 34 is not subject to an open aperture to maximize shading and provide optimal insulation. Thermal mass wall 35 absorbs heat and can release it at night and thus contributes pre-cooling air circulation. Trombe wall solar chimney 36 provides a stack effect ventilation engine having a high point exhaust, and also supplies light distribution. Arrows 37 show the path of warm air exhaust through solar chimney 36 and provides an engine for ground-coupled cooling air intake. Operable ventilation panel and light monitor are shown by reference number 38. Air cooling and dehumidification plenum 39 is included to distribute conditioned air from elsewhere in the building. It is part of an aperture-regulated, conditioning labyrinth. A cooling air portal 40 is controlled by the aperture. Solarium heat ventilation 41 is aperture regulated and provides an additional engine for ground-coupled air intake. In-floor cool air supply and distribution 42 may also be included. Daylighting occurs through light monitor and solarium portals 43. Light monitor 44 supplies direct daylighting. Arrow 45 indicates ground cooled gravity driven, outside air entering the system.

Seasonal advancement of the solar aperture events produces gradual change throughout the year with amounts of solar gain, shading effect, and ventilation transition from cooling to warming all preferably approaching half capacity during the equinoxes, meeting each season's average needs.

It is noted that although movement of the system is described as continuous, this is merely an illustrative embodiment of the invention. The motion can be interrupted either manually or programmed to be active or inactive for chosen periods of time.

It is further noted that the invention may include automated sensors and control systems, but can have an override mechanism or sensor feedback loop type of mechanism. This may be used for example for periods of unseasonal temperatures or other weather conditions. The system can include software to direct functioning and movement of the components and can be integrated with processors, memory devices, sensors and other electronic components. The system can respond to variable natural or man-made conditions, such as shadows caused by nearby structures or weather variations. The embodiment of the invention though, which comprises two rotating concentric shields of shading insulation without the additional electronic controls, can be effective at regulating conditions within the building.

Various embodiments of the invention have been described, each having a different combination of elements. The invention is not limited to the specific embodiments disclosed, and may include different combinations of the elements disclosed, or omission of some elements, and the equivalents of such elements.

While the invention has been described by illustrative embodiments, additional advantages and modifications will occur to those skilled in the art. Therefore, the invention in its broader aspects is not limited to specific details shown and described herein. Modifications may be made without departing from the spirit and scope of the invention. Accordingly, it is intended that the invention not be limited to the specific illustrative embodiments, but be interpreted within the full spirit and scope of the appended claims and their equivalents and any description contained herein.

The invention claimed is:

1. A solar energy apparatus for conditioning a building, the apparatus comprising:

a first shield having a generalized cylindrical shape, the first shield having an opening along its curved surface, wherein the first shield is configured to rotate at a first rotational speed;

a second shield having a generalized cylindrical shape the second shield having an opening along its curved surface, wherein the second shield is configured to rotate concentrically with the first shield and at a second rotational speed, wherein the second rotational speed is greater than the first rotational speed;

the combined openings of the first shield and the second shield forming a rotating aperture through which solar energy can pass, wherein the aperture is variable in size due to the speed differential between the first rotational speed and the second rotational speed;

an actuating assembly for rotating the first shield and the second shield;

wherein the rotation and position of the aperture vary to produce a selected amount of solar gain or shading;

wherein the first shield is configured to complete about one rotation per year; and the second shield is configured to rotate slightly more than one rotation per day.

2. The apparatus of claim 1 wherein:

the first shield operates at a first constant rotational speed; and the second shield operates at a second constant rotational speed.

3. The apparatus of claim 1 wherein the shields rotate in the same direction.

4. The apparatus of claim 1 wherein each of the first shield and the second shield extends around at least half of the building's perimeter.

5. The apparatus of claim 1 wherein the first shield and second shield comprise insulating material.

6. The apparatus of claim 1 wherein the first shield and second shield are substantially opaque to solar energy.

7. The apparatus of claim 1 wherein the actuating assembly comprises:

a track system configured to support the first shield and second shield and along which the first shield and second shield can rotate; and a motorized propulsion assembly for rotating the first shield and second shield about the track system with respect to the building.

8. The apparatus of claim 1 wherein:

the first shield and second shield are configured and positioned to interact so that the aperture width and position are proportional to average external temperatures; and the rotation of the first shield and second shield results in an aperture that increases gradually throughout the day to a maximum size at a first selected time and gradually decreases toward the evening to close at a second selected time.

9. The apparatus of claim 1 wherein the first shield and second shield are configured so the aperture admits an increasing amount of direct sunlight each day until the maximum amount of direct sunlight is admitted at the coldest time in an average year and so the aperture provides an increasing amount of shade while maintaining maximum daylight until the maximum amount of shade occurs at the hottest time in an average year.

10. The apparatus of claim 1 wherein at least one of the first shield opening and second shield opening is positioned so that the daily rotational gain of the first shield causes the midpoint of the first shield opening and/or the second shield opening to align toward the south at the coldest time in the year and toward the north at the warmest time in the year.

11. The apparatus of claim 1 further comprising:

a fixed time pointer on the first shield;

time demarcations indicated on the second shield;

wherein the fixed time pointer progressively points to the time demarcations on the second shield as the first shield and second shield rotate around the building;

a fixed calendar pointer on the building;

calendar demarcations indicated on the first shield;

wherein the fixed calendar pointer progressively points to the calendar demarcations on the first shield as the first shield and second shield rotate around the building.

12. The apparatus of claim 1 further comprising:

a system having one or more processors;

an input device connected to the processor(s), a machine-readable medium having machine-readable program code to program the speed and movement of the first shield, second shield and actuating assembly; and a machine readable storage medium containing executable code.

13. The solar-energy apparatus of claim 1 further comprising the building.

14. The building of claim 13 further comprising:

a networked ventilation system operably engaged to at least one shield for moving thermal energy within and without the building.

15. The building of claim 13 wherein the networked ventilation system further comprises:

a plurality of cooling portals disposed along the perimeter of the solar-energy apparatus configured for regulating the building's cooling capacity;

wherein the cooling portals are operably engaged to the first shield such that the rotational gain of the first shield opens an increasing amount of cooling ventilation portals until a maximum amount of cooling portals are open at a first preset time coinciding with the warmest time in the year and closes an increasing amount of cooling portals until all the cooling portals are closed at a second preset time coinciding with the coldest time of the year;

a plurality of warming portals disposed along the perimeter of the building configured for regulating the building's heating capacity; and wherein the warming portals are operably engaged to the first shield such that the rotational gain of the first shield opens an increasing number of warming portals until a maximum amount of warming portals are open at the first preset time coinciding with the coldest time in the year and closes an increasing amount of warming portals until all the warming portals are closed at the second preset time coinciding with the warmest time of the year.

16. The building of claim 13 wherein the networked ventilation system further comprises:

a plurality of internal circulation portals disposed further within the perimeter of the building for transferring thermal energy within the building;

wherein the internal circulation portals are operably engaged to the second shield such that the rotational gain of the second shield opens an increasing amount of the circulation portals until the maximum amount of circulation portals are open at a first preset time coinciding with the warmest time of the day, and such that the rotational gain of the first shield closes an increasing amount of circulation portals until all the circulation portals are closed at a second preset time coinciding with the coldest time of day; and wherein as the seasonal temperatures get warmer an increasing amount of the circulation portals are opened until the maximum amount of circulation portals are open at a first preset time coinciding with the coldest time of the day, and an increasing amount of circulation portals are closed until all the circulation portals are closed at a second preset time coinciding with the warmest time of day.

17. The building of claim 13 comprising a plurality of ventilation portals and a plurality of circulation portals;

wherein the ventilation portals and the circulation portals are activated by a shield engaging a switch mechanism.

18. The building of claim 13 comprising:

a plurality of windows, wherein the shields rotate around the windows thereby blocking and admitting sunlight in response to passing of the aperture.

19. A method of conditioning a building comprising:

providing a solar energy apparatus according to claim 1;

determining the historically warmest month of the year and coldest month of the year at the building's location;

determining the historically warmest time of day and coldest time of day at the building's location;

calibrating the shields in accordance with the building's location by:

orienting the first shield opening toward the south at the historically coldest month of the year; and orienting the second shield opening toward the south at the historically coldest time of day.

* * * * *